US008805213B2

(12) United States Patent
Hikosaka

(10) Patent No.: US 8,805,213 B2
(45) Date of Patent: Aug. 12, 2014

(54) TONER CALCULATION IN AN IMAGE FORMING DEVICE

(75) Inventor: Ariyoshi Hikosaka, Osaka (JP)

(73) Assignee: KYOCERA Document Solutions Inc. (JP)

( * ) Notice: Subject to any disclaimer, the term of this patent is extended or adjusted under 35 U.S.C. 154(b) by 197 days.

(21) Appl. No.: 13/330,287

(22) Filed: Dec. 19, 2011

(65) Prior Publication Data

US 2012/0155893 A1 Jun. 21, 2012

(30) Foreign Application Priority Data

Dec. 20, 2010 (JP) ..... 2010-283768

(51) Int. Cl.
*G03G 15/08* (2006.01)
*G03G 15/00* (2006.01)

(52) U.S. Cl.
CPC ..... *G03G 15/5062* (2013.01); *G03G 15/0824* (2013.01)
USPC ..... 399/27

(58) Field of Classification Search
USPC ..... 399/27
See application file for complete search history.

(56) References Cited

U.S. PATENT DOCUMENTS

| | | | | |
|---|---|---|---|---|
| 5,349,377 | A * | 9/1994 | Gilliland et al. | 347/131 |
| 2001/0043259 | A1 * | 11/2001 | Ogata | 347/140 |
| 2004/0156645 | A1 * | 8/2004 | Nakazato | 399/27 |
| 2006/0127108 | A1 * | 6/2006 | Okuyama et al. | 399/27 |
| 2007/0058996 | A1 * | 3/2007 | Sakita et al. | 399/27 |

FOREIGN PATENT DOCUMENTS

| | | | |
|---|---|---|---|
| CN | 1790182 | | 6/2006 |
| JP | 2002174929 | A * | 6/2002 |
| JP | 2004163553 | A * | 6/2004 |
| JP | 2005-173088 | | 6/2005 |
| JP | 2007-078886 | | 3/2007 |

* cited by examiner

*Primary Examiner* — David Gray
*Assistant Examiner* — Tyler Hardman
(74) *Attorney, Agent, or Firm* — McDonnell Boehnen Hulbert & Berghoff LLP

(57) ABSTRACT

Provided is an image forming apparatus that consumes toner to form an image, including a first calculation portion, a second calculation portion, and a third calculation portion. The first calculation portion calculates a toner consumption by a first calculation method. The second calculation portion calculates the toner consumption by a second calculation method according to a predetermined calculation formula after a predetermined switching criterion is satisfied. The third calculation portion calculates a value of a parameter in the predetermined calculation formula of the second calculation method based on the toner consumption calculated by the first calculation method.

15 Claims, 5 Drawing Sheets

FIRST PERIOD $$Xt1=X11+\ldots+X1n$$
$$Yt1=Y11+\ldots+Y1n$$
$$a\times Xt1+b\times Yt1=To$$

SECOND PERIOD $$Xt2=X21+\ldots+X2m$$
$$Yt2=Y21+\ldots+Y2m$$
$$a\times Xt2+b\times Yt2=To$$

PARAMETER VALUE a , b $$a=\frac{(Yt2-Yt1)To}{Yt2Xt1-Yt1Xt2}$$

$$b=\frac{(Xt2-Xt1)To}{Xt2Yt1-Xt1Yt2}$$

TONER CALCULATION IN AN IMAGE FORMING DEVICE

INCORPORATION BY REFERENCE

This application is based upon and claims the benefit of priority from the corresponding Japanese Patent application No. 2010-283768, filed Dec. 20, 2010, the entire contents of which is incorporated herein by reference.

BACKGROUND

The present invention relates to an image forming apparatus that consumes toner to form an image and a toner consumption calculation method of calculating a toner consumption that is an amount of toner consumed in image formation.

Image forming apparatuses of an electrophotographic process—including printers and multifunction peripherals—extract toner from a toner cartridge to form an image. Some image forming apparatuses can measure an amount of toner consumed during an image formation. In a normal state, the toner consumption is measured (that is, calculated) indirectly from image data, an operation count of a device that contains a toner cartridge, and the like.

On some image forming apparatuses, until the toner consumption reaches a predetermined value, the toner consumption is calculated based on the operation count and an operating time of the device that contains the toner cartridge. After the toner consumption reaches the predetermined value, the toner consumption is henceforth calculated based on the number of dots in the image and data values of the image data.

When calculating the toner consumption based on the operation count and the operating time of the device that contains the toner cartridge, it is possible to accurately calculate the toner consumption when a toner remaining amount is large, but an error is likely to occur when the toner remaining amount becomes small. Further, in the case of calculating the toner consumption based on the number of dots in the image and the data values of the image data, it is difficult to accurately calculate the toner consumption because the toner consumption fluctuates according to contents of the image, variations or changes in reproduction characteristics of toner densities corresponding to the values of the image data, and the like.

SUMMARY

An image forming apparatus according to one aspect of the present disclosure consumes toner to form an image, and includes a first calculation portion, a second calculation portion, and a third calculation portion. The first calculation portion calculates a toner consumption by a first calculation method. The second calculation portion calculates the toner consumption by a second calculation method according to a predetermined calculation formula after a predetermined switching criterion is satisfied. The third calculation portion calculates a value of a parameter in the calculation formula of the second calculation method based on the toner consumption calculated by the first calculation method.

A toner consumption calculation method according to a first aspect of the present description includes calculating a toner consumption that is an amount of toner consumed in image formation, and includes a first toner calculating, a second toner calculating, and a parameter calculating. The first toner calculating includes calculating the toner consumption by a first calculation method. The second toner calculating includes calculating the toner consumption by a second calculation method according to a predetermined calculation formula after a predetermined switching criterion is satisfied. The parameter calculating includes calculating a value of a parameter in the predetermined calculation formula of the second calculation method based on the toner consumption calculated by the first calculation method.

Additional features and advantages are described herein, and will be apparent from the following Detailed Description and the figures.

DETAILED DESCRIPTION

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the present disclosure without departing from the scope or spirit of the present disclosure. For instance, features illustrated or described as part of one embodiment can be used in another embodiment to yield a still further embodiment. It is intended that the present disclosure cover such modifications, combinations, additions, deletions, applications and variations that come within the scope of the appended claims and their equivalents.

Hereinafter, an embodiment of the present disclosure is described with reference to the accompanying drawings.

Figure 1:
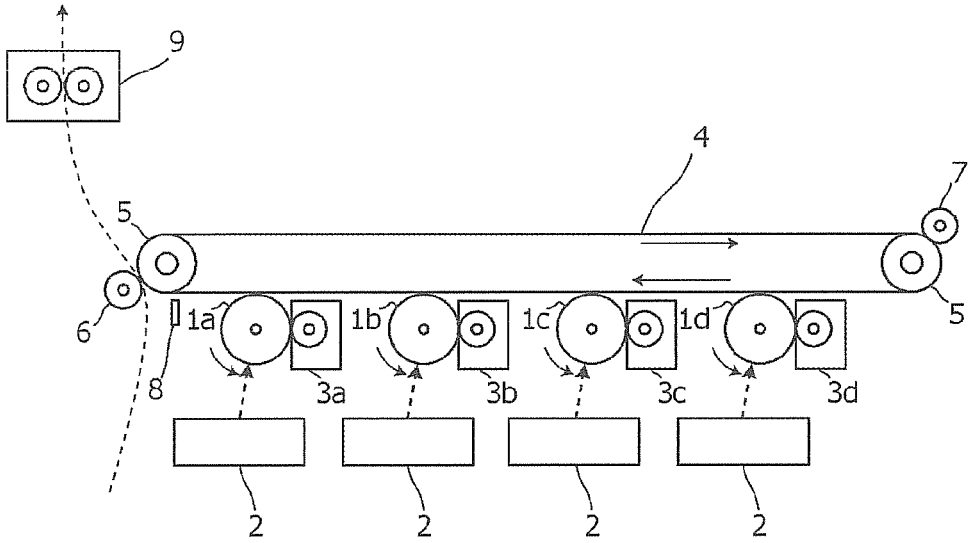
FIG. 1 is a side view partially illustrating an internal mechanical structure of an image forming apparatus according to an embodiment of the present disclosure.

FIG. 1 is a side view partially illustrating an internal mechanical structure of an image forming apparatus according to this embodiment. The image forming apparatus is an apparatus having a printing function of an electrophotographic process such as a printer, a facsimile apparatus, a copier, or a multifunction peripheral.

The image forming apparatus according to this embodiment includes a tandem color developing apparatus. The color developing apparatus includes photosensitive drums 1*a* to 1*d*, exposure devices 2, and developing units 3*a* to 3*d*. The photosensitive drums 1*a* to 1*d* are photosensitive members of four colors, i.e., cyan, magenta, yellow, and black. The photosensitive drums 1*a* to 1*d* are made of, for example, amorphous silicon.

The exposure devices 2 are devices that form electrostatic latent images by irradiating the photosensitive drums 1*a* to 1*d* while scanning laser light. The laser light is scanned in a direction (main scanning direction) perpendicular to a rotational direction (sub scanning direction) of the photosensitive drums 1*a* to 1*d*. The exposure devices 2 each include a laser diode that is a light source of the laser light and a laser scanning unit including optical elements (such as lens, mirror, and polygon mirror) that guide the laser light to a corresponding one of the photosensitive drums 1*a* to 1*d*.

In addition, chargers such as scorotrons, cleaning devices, static eliminators, and the like are arranged around the photosensitive drums 1*a* to 1*d*. The cleaning devices eliminate residual toner on the photosensitive drums 1*a* to 1*d* after a primary transfer, and the static eliminators eliminate static electricity from the photosensitive drums 1*a* to 1*d* after the primary transfer.

The developing units 3*a* to 3*d* include toner cartridges that are respectively filled with toner of the four colors, i.e., cyan, magenta, yellow, and black, and developing devices that cause toner carried from toner hoppers inside the toner cartridges to adhere to the photosensitive drums 1*a* to 1*d*. The developing units 3*a* to 3*d* form toner images by causing the toner to adhere to the electrostatic latent images on the photosensitive drums 1*a* to 1*d*. The toner is carried from the toner hopper to the developing device by a toner carrying portion operated by a drive unit such as a motor (not shown).

Development in magenta is performed by the photosensitive drum 1*a* and the developing unit 3*a*, development in cyan is performed by the photosensitive drum 1*b* and the developing unit 3*b*, development in yellow is performed by the photosensitive drum 1*c* and the developing unit 3*c*, and development in black is performed by the photosensitive drum 1*d* and the developing unit 3*d*.

An intermediate transfer belt 4 is a circular image bearing member (intermediate transfer member) which is brought into contact with the photosensitive drums 1*a* to 1*d* and onto which the toner images on the photosensitive drums 1*a* to 1*d* are primarily transferred. The intermediate transfer belt 4 is stretched around a drive roller 5, and is driven by the drive roller 5 to revolve from a contact position with the photosensitive drum 1*d* to a contact position with the photosensitive drum 1*a*.

A transfer roller 6 brings a conveyed paper sheet into contact with the intermediate transfer belt 4, and secondarily transfers the toner image on the intermediate transfer belt 4 onto the paper sheet. Note that the paper sheet onto which the toner image has been transferred is conveyed to a fixing device 9, and the toner image is fixed to the paper sheet.

A roller 7 includes a cleaning brush, and brings the cleaning brush into contact with the intermediate transfer belt 4 to eliminate toner remaining on the intermediate transfer belt 4 after the toner image has been transferred onto the paper sheet.

A sensor 8 applies a light beam to the intermediate transfer belt 4, and detects reflected light from a surface of the intermediate transfer belt 4 or a toner pattern on the surface. For example, during a toner density adjustment, the sensor 8 applies a light beam to a predetermined area of the intermediate transfer belt 4, detects reflected light of the light beam, and outputs an electrical signal corresponding to an amount of the light.

Figure 2:
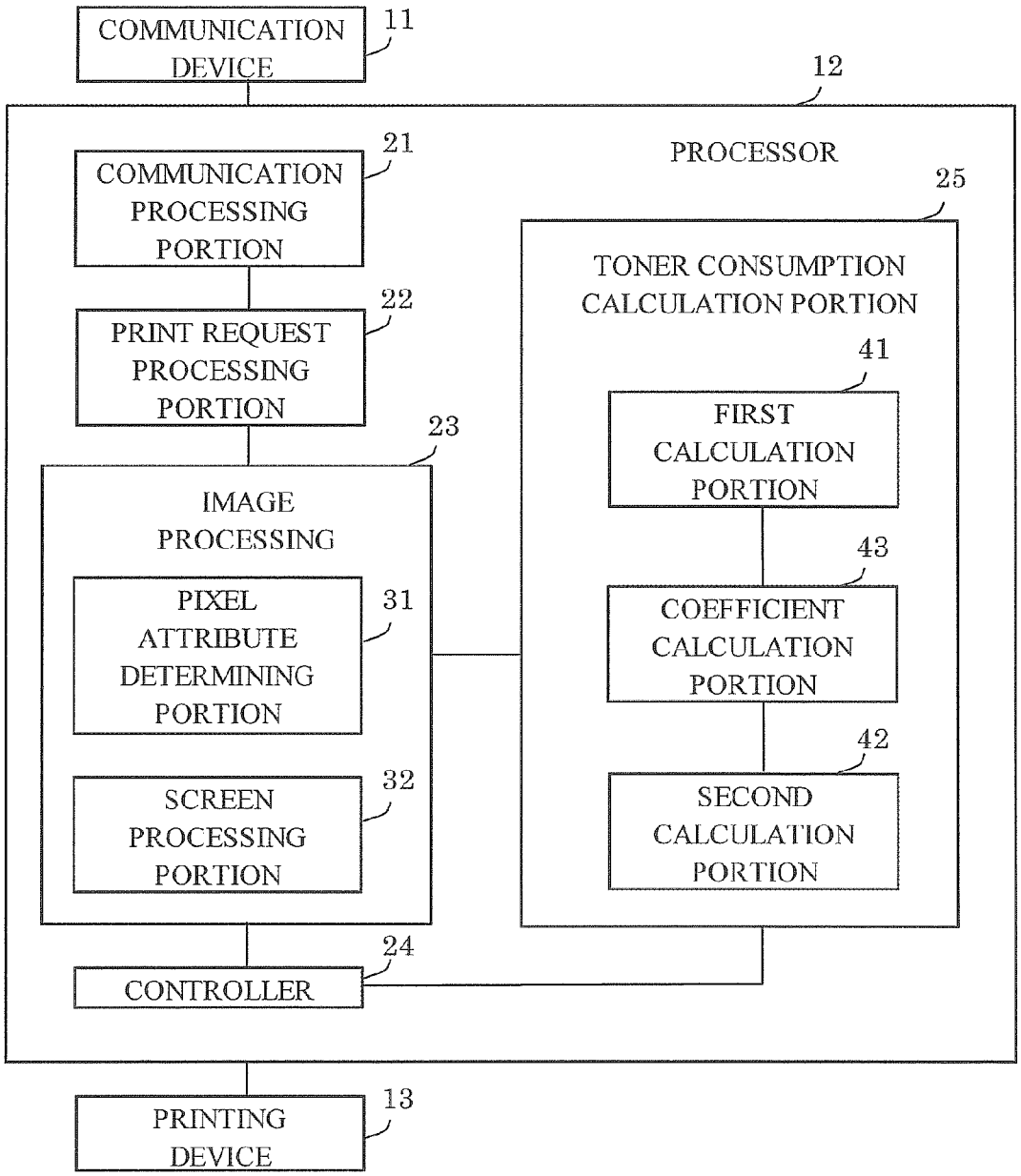
FIG. 2 is a block diagram partially illustrating an electrical structure of the image forming apparatus according to the embodiment of the present disclosure.

FIG. 2 is a block diagram partially illustrating an electrical structure of the image forming apparatus according to this embodiment. As illustrated in FIG. 2, the image forming apparatus includes a communication device 11, a processor 12, and a printing device 13.

The communication device 11 is a device that can be connected to a host device via a network or a peripheral device interface and performs data communications by a predetermined communication protocol.

The processor 12 is a computer including a central processing unit (CPU), a read only memory (ROM), and a random access memory (RAM), and implements various processing portions by loading programs from a storage device (not shown), the ROM, and the like into the RAM and causing the CPU to execute the programs.

The printing device 13 is an internal device that prints a document image and has a mechanical structure as illustrated in FIG. 1.

After startup of the image forming apparatus, the various programs are executed by the processor 12 as needed. In this embodiment, the processor 12 implements the processing portions such as an operating system (not shown), a communication processing portion 21, a print request processing portion 22, an image processing portion 23, a controller 24, and a toner consumption calculation portion 25.

The communication processing portion 21 is a processing portion that controls the communication device 11 to execute the data communications with the host device or the like. For example, the communication processing portion 21 receives document data as a print request from the host device.

Further, the print request processing portion 22 receives the print request based on a user operation via an operation panel and the print request supplied from the host device, and causes print jobs corresponding to the requests to be executed. For example, when the document data having a predetermined data format such as a page description language (PDL) or a portable document format (PDF) is received as the print request from the host device, the print request processing portion 22 generates image data from the document data. The image data is bitmap data, and if the document data is received from the host device as bitmap data, the print request processing portion 22 uses the document data as the image data.

Further, the image processing portion 23 executes a predetermined image process on the image data, and generates print data (for example, binary-format print image data for every color). The image processing portion 23 includes a pixel attribute determining portion 31 and a screen processing portion 32.

The pixel attribute determining portion 31 identifies a pixel attribute of each pixel from attribute data on each of the pixels in the image data, and identifies a character area, a gradation area (area having halftones of a photograph or the like), and the like in the image data.

The screen processing portion 32 generates the print data by a predetermined screen method. The screen processing portion 32 may change the screen method according to the pixel attribute identified by the pixel attribute determining portion 31.

Further, the controller 24 is a processing portion that monitors and controls the internal device such as the printing device 13. The controller 24 is a processing circuit that causes the development, transfer, and fixation of the toner images and sheet feeding, printing, and delivery to be executed. In order to perform these processes, the controller 24 controls a drive source (not shown) that drives the above-mentioned rollers and the like, a bias application circuit that applies a developing bias and a primary transfer bias, and the exposure devices 2. The developing bias is applied between the photosensitive drums 1*a* to 1*d* and the developing units 3*a* to 3*d*, respectively, and the primary transfer bias is applied between the photosensitive drums 1*a* to 1*d* and the intermediate transfer belt 4, respectively. In particular, the controller 24 controls toner to be carried in the developing units 3*a* to 3*d* by controlling the drive units that cause the above-mentioned toner carrying portions to operate.

Further, the toner consumption calculation portion 25 calculates a toner consumption involved in the printing process performed by the printing device 13. In addition, the toner consumption calculation portion 25 calculates an amount of toner remaining inside the toner cartridge resulting from the toner consumption. In addition, the toner consumption calculation portion 25 displays the toner consumption and the remaining amount of toner on an operation panel (not shown), and displays an alert message on the operation panel (not shown) when the toner remaining amount becomes small.

The toner consumption calculation portion 25 includes a first calculation portion 41, a second calculation portion 42, and a coefficient calculation portion 43.

The first calculation portion 41 calculates the toner consumption by a first calculation method until a predetermined switching criterion is satisfied. In this embodiment, the first calculation method is a method of calculating the toner consumption based on an operation count or an operating time (integrated value of the operating time) of the toner carrying portion that carries toner from the toner cartridge. Further, in this embodiment, the switching criterion is whether or not the integrated value of the toner consumption calculated by the first calculation method has reached a predetermined threshold value (for example, 90% of a total amount of toner inside the toner cartridge), and the predetermined threshold value is a value within a range in which a toner supplying time and the integrated value of the toner consumption are substantially proportional to each other and experimentally determined or the like.

The second calculation portion 42 calculates the toner consumption by a second calculation method according to a predetermined calculation formula after the predetermined switching criterion is satisfied. In this embodiment, the second calculation portion 42 calculates the toner consumption based on data values (pixel values of the image data before the screen process or presence/absence of dots after the screen process) regarding a plurality of pixel attributes in the image data and respective parameters for the plurality of pixel attributes. More specifically, in this embodiment, the second calculation portion 42 calculates the toner consumption based on a sum of products of printing ratios regarding the plurality of pixel attributes in the image data and the respective parameters (that is, coefficients) for the plurality of pixel attributes. Note that the pixel attribute of each pixel is identified by the pixel attribute determining portion 31 based on, for example, attribute data included in the image data.

Figure 3:
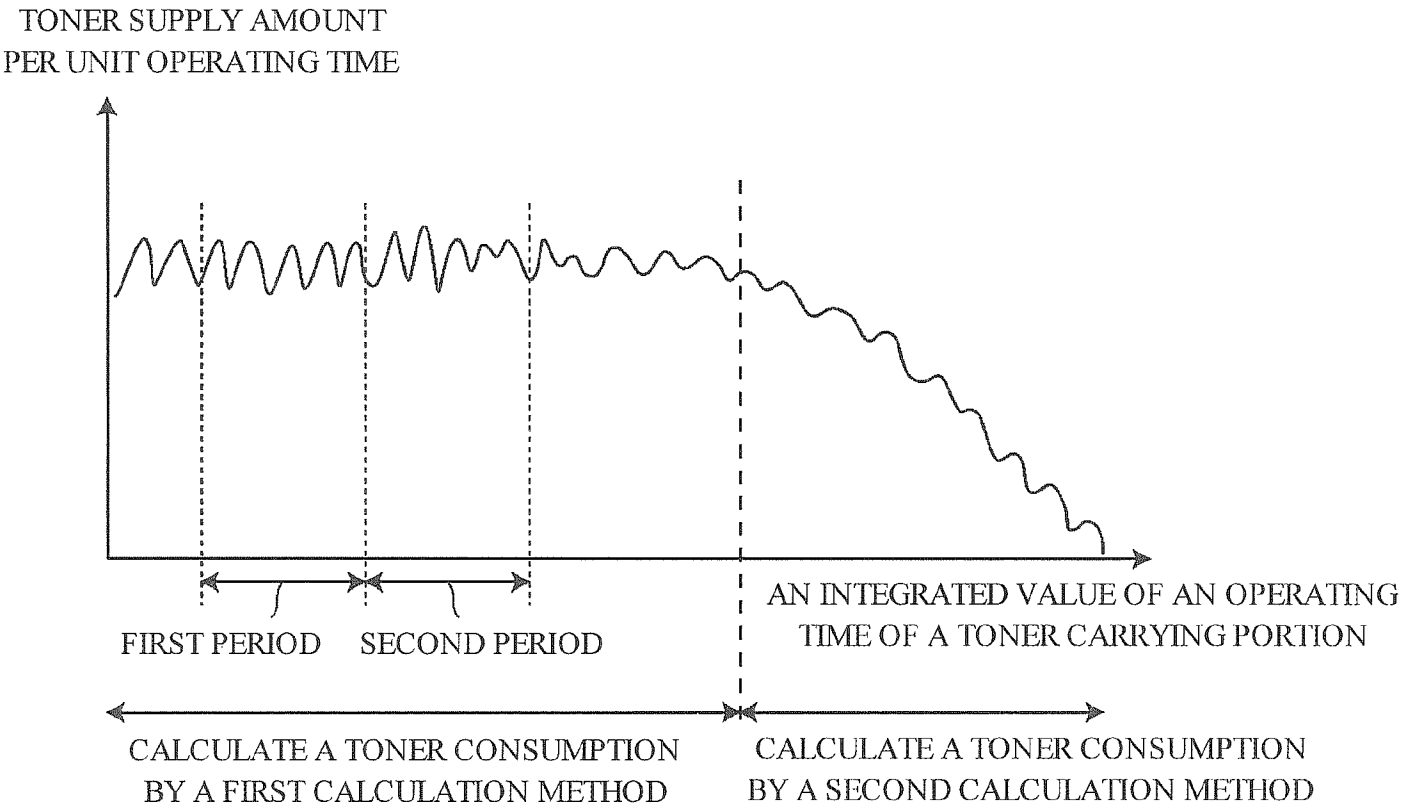
FIG. 3 is a diagram illustrating a relationship between an integrated value of an operating time of a toner carrying portion and a toner supply amount per unit operating time carried by the toner carrying portion.

FIG. 3 is a diagram illustrating a relationship between an integrated value of the operating time of the toner carrying portion and a toner supply amount per unit operating time carried by the toner carrying portion.

In this embodiment, the number of the plurality of pixel attributes is two. One of the plurality of pixel attributes is a character attribute, and the other is a gradation attribute. Further, in this embodiment, as illustrated in FIG. 3, while the toner consumption is calculated by the first calculation method, the toner consumption is calculated within each of a number of periods (i.e., a plurality of periods) equal to the number of pixel attributes (that is, two, corresponding to a first period and a second period). Further, as illustrated in FIG. 3, while the toner consumption is calculated by the first calculation method, the toner supply amount per unit time periodically fluctuates, but in this embodiment, a duration of each of the plurality of periods is set to become sufficiently longer than a fluctuation cycle of the above-mentioned toner supply amount per unit time. Note that the number of the plurality of pixel attributes may be three or more. Further, the number of the plurality of periods may be larger than the number of the plurality of pixel attributes.

The coefficient calculation portion 43 calculates a value of a parameter in a calculation formula of the second calculation method based on the toner consumption calculated by the first calculation method. In this embodiment, the parameters are coefficients for the respective pixel attributes used by the second calculation portion 42. In this embodiment, the coefficient calculation portion 43 calculates data values regarding the plurality of pixel attributes within the plurality of periods, and calculates the values of the parameters from the toner consumption calculated by the first calculation method within the respective periods and the data values calculated corresponding to the periods. More specifically, the coefficient calculation portion 43 calculates the printing ratios regarding the plurality of pixel attributes within the plurality of periods, and calculates the values of the parameters from the toner consumption calculated by the first calculation method within the respective periods and the printing ratios calculated corresponding to the periods.

Next, referring to FIG. 3, description is made of an operation of the above-mentioned image forming apparatus.

In each of the developing units 3*a* to 3*d*, toner is supplied from the toner cartridge to the developing device. The toner carrying portion performs a toner carrying operation to supply toner from the toner cartridge to the developing device by a predetermined operating time per operation. An amount of toner supplied per operation is substantially fixed regardless of fluctuations to some extent when the toner remaining amount is large, but when the toner remaining amount is small, the amount of toner supplied becomes smaller with larger fluctuations as the toner remaining amount becomes smaller. Note that a fixed amount of toner supplied per operation when the toner remaining amount is large is experimentally determined or the like and stored. For example, in a case where the toner contains a magnetic carrier, the above-mentioned fixed amount of toner can be measured by measuring a ratio (T/C) of the toner to the magnetic carrier based on magnetic permeability.

Therefore, when the toner remaining amount is large, the first calculation portion 41 acquires information on the operation count or the operating time of the toner carrying portion from the controller 24, and calculates the toner consumption by the first calculation method. More specifically, the toner consumption is calculated from the product of (i) the above-mentioned fixed amount of toner that is previously measured and stored and (ii) the acquired operation count of the toner carrying portion. While the toner consumption is accurately calculated by the first calculation method, the coefficient calculation portion 43 calculates the values of the parameters used by the second calculation method. On the other hand, when the toner remaining amount is small, the second calculation portion 42 calculates the toner consumption by the second calculation method by using a parameter value calculated by the coefficient calculation portion 43 based on the image data before the screen process or after the screen process.

Figure 4:
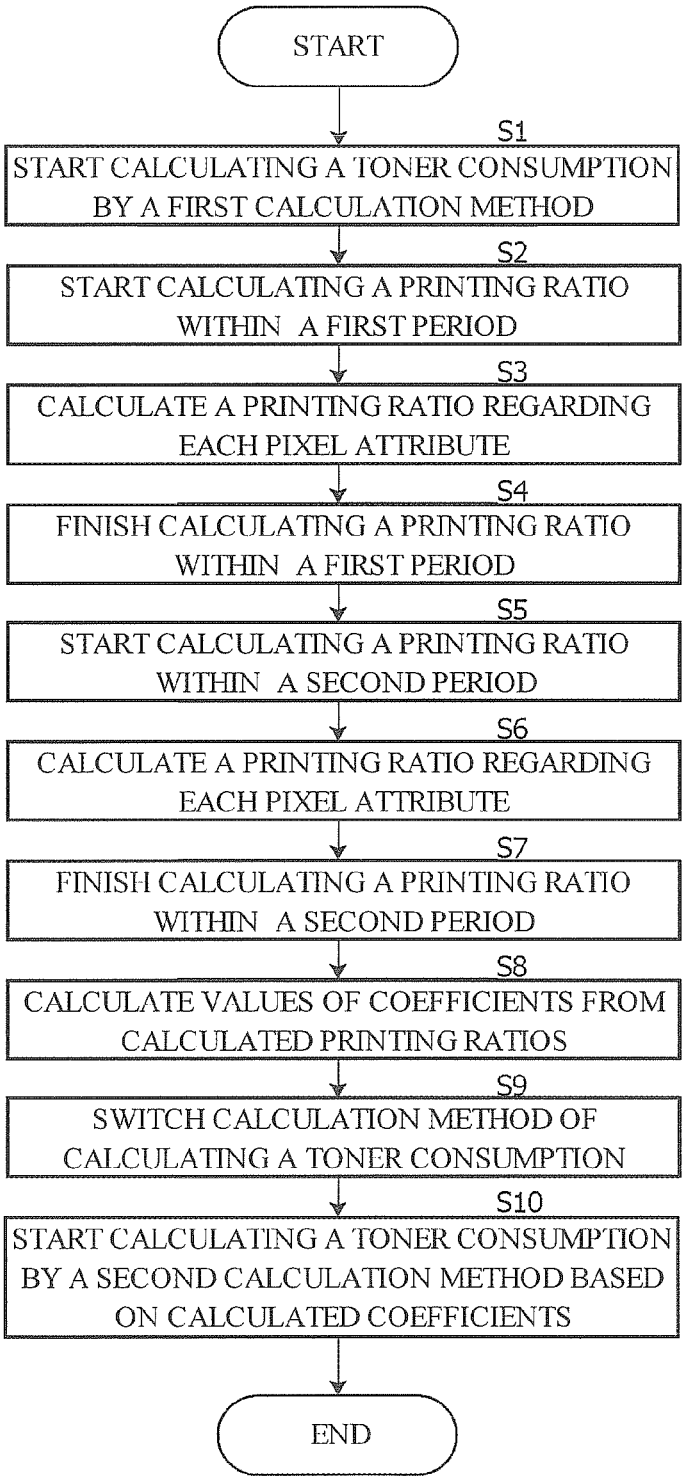
FIG. 4 is a flowchart illustrating how a toner consumption is calculated by the image forming apparatus according to this embodiment.
Figure 5:
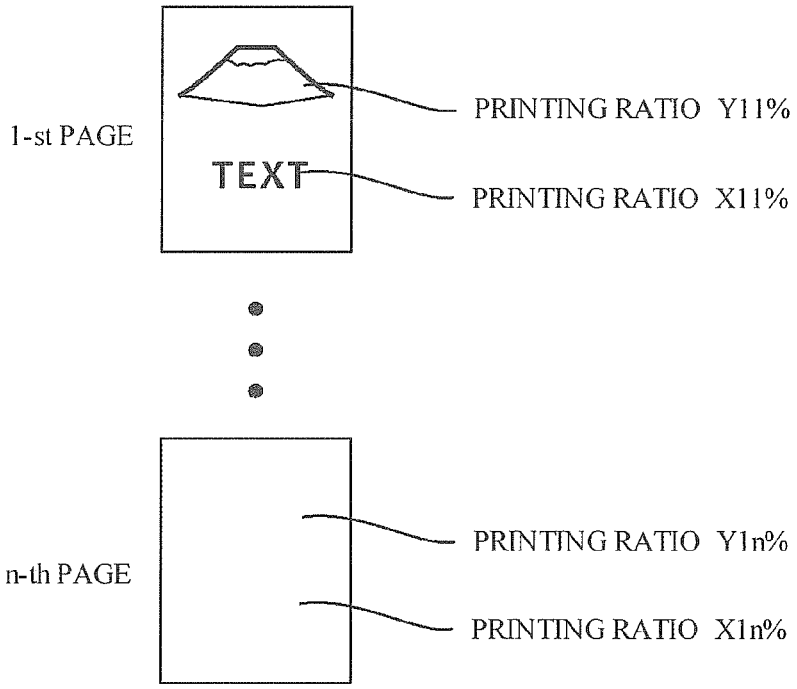
FIG. 5 is a diagram illustrating a method of calculating values of parameters according to this embodiment.

FIG. 4 is a flowchart illustrating how the toner consumption is calculated by the image forming apparatus according to this embodiment. FIG. 5 is a diagram illustrating a method of calculating values of parameters according to this embodiment.

First, when the toner remaining amount of the toner cartridge is 100%, for example, when the toner cartridge is replaced, the first calculation portion 41 resets the integrated value of the toner consumption to zero, and starts calculating the toner consumption by the first calculation method (Step S1). After that, every time the printing device 13 performs an operation that involves consumption of toner such as a printing operation or density correction, the first calculation portion 41 calculates the toner consumption regarding the operation, and updates the integrated value of the toner consumption and the value of the toner remaining amount based on the toner consumption.

After that, the coefficient calculation portion 43 monitors the integrated value of the toner consumption calculated by the first calculation portion 41, and when the integrated value of the toner consumption reaches a predetermined value, starts calculating the printing ratio within the first period (Step S2).

The coefficient calculation portion 43 stores the integrated value of the toner consumption at the time it starts calculating the printing ratio within the first period, and continues to calculate the printing ratio within the first period until an increase amount of the integrated value of the toner consumption reaches a predetermined threshold value To (for example, 50 grams). At this time, as illustrated in FIG. 5, the coefficient calculation portion 43 calculates the printing ratio of each page regarding each pixel attribute from the number of dots in the image data (print data) after the screen process or the like (Step S3). That is, the printing ratio X1*i* (i=1, 2, . . . , n) regarding a character attribute area and the printing ratio Y1*i* (i=1, 2, . . . , n) regarding a gradation attribute area are calculated.

Then, the coefficient calculation portion 43 finishes calculating the printing ratio within the first period when the increase amount of the integrated value of the toner consumption reaches the predetermined threshold value To (Step S4). The coefficient calculation portion 43 calculates total sums Xt1 and Yt1 of the printing ratios regarding the character attribute area and the gradation attribute area within the first period. For example, as illustrated in FIG. 5, in a case where the print data includes first to n-th pages, the total sum of the printing ratios regarding the character attribute area and the total sum of the printing ratios regarding the gradation attribute area are calculated as Xt1=X11+ . . . +X1*n* and Yt1=Y11+ . . . +Y1*n*, respectively.

After the end of the first period, when the integrated value of the toner consumption reaches a predetermined value, the coefficient calculation portion 43 starts calculating the printing ratio within the second period (Step S5), calculates the printing ratio regarding each pixel attribute (Step S6), and when the increase amount of the integrated value of the toner consumption from the start of the second period reaches the predetermined threshold value To (for example, 50 grams), finishes calculating the printing ratio within the second period (Step S7). The coefficient calculation portion 43 calculates the total sums Xt2 and Yt2 of the printing ratios regarding the character attribute area and the gradation attribute area within the second period. For example, as illustrated in FIG. 5, in a case where the print data includes first to m-th pages, the total sum of the printing ratios regarding the character attribute area and the total sum of the printing ratios regarding the gradation attribute area are calculated as Xt2=X21+ . . . +X2*m* and Yt2=Y21+ . . . +Y2*m*, respectively.

Then, after the end of the second period, as illustrated in FIG. 5, the coefficient calculation portion 43 calculates the values of the parameters (here, coefficients "a" and "b") in the calculation formula of the second calculation method for calculating the toner consumption from the printing ratios, based on the above-mentioned threshold value To, the total sums Xt1 and Yt1 of the printing ratios regarding the respective pixel attributes within the first period and the total sums Xt2 and Yt2 of the printing ratios regarding the respective pixel attributes within the second period (Step S8). In other words, for example, as illustrated in FIG. 5, the toner consumption within the first period is calculated as a×Xt1+b×Yt1, and the toner consumption within the second period is calculated as a×Xt2+b×Yt2, each of which is equal to the above-mentioned threshold value To. Accordingly, the parameter values are calculated as a=(Yt2−Yt1)·To/(Yt2·Xt1−Yt1·Xt2) and b=(Xt2−Xt1)·To/(Xt2·Yt1−Xt1·Yt2).

After that, when the integrated value of the toner consumption reaches a predetermined reference value, the second calculation portion 42 starts calculating the toner consumption (Step S9). Then, the second calculation portion 42 calculates the printing ratio of each page regarding each pixel attribute until the toner remaining amount of the toner cartridge becomes zero or until the toner cartridge is replaced, and based on the printing ratio and the parameter values calculated by the coefficient calculation portion 43, calculates the toner consumption for each page according to the following equation, while using the toner consumption to update the integrated value of the toner consumption (Step S10).

$$T=a\times X+b\times Y$$

In the above-mentioned equation, T represents the toner consumption for one page, X represents the printing ratio regarding the character attribute area, and Y represents the printing ratio of the gradation attribute area.

As described above, according to this embodiment, the first calculation portion 41 calculates the toner consumption by the first calculation method until the predetermined switching criterion is satisfied, and the second calculation portion 42 calculates the toner consumption by the second calculation method after the predetermined switching criterion is satisfied. The coefficient calculation portion 43 calculates the values of the parameters used by the second calculation method based on the toner consumption calculated by the first calculation method.

According to this embodiment, it is easy to accurately calculate the toner consumption when the toner remaining amount is large, and hence the respective parameters for the plurality of pixel attributes are calculated at that time. Then, when the toner remaining amount is small, those parameters are used to calculate the toner consumption. With this arrangement, when the toner remaining amount becomes small, it is possible to calculate the toner consumption in consideration of the pixel attributes. Accordingly, the toner consumption can be calculated with more accuracy than in a case where the pixel attributes are not taken into consideration.

In the above-mentioned embodiment, the toner consumption calculation portion 25 calculates the printing ratio from the image data (print data) after the screen process, but on an image forming apparatus according to another embodiment, the toner consumption calculation portion 25 calculates the printing ratio from the pixel values of the image data before the screen process. Note that the structure, configuration, and operation of the image forming apparatus according to another embodiment are the same as those of the above-mentioned embodiment, and hence description thereof is omitted.

Note that the above-mentioned embodiment is an example of the present invention, but the present invention is not limited thereto, and various modifications and changes can be made within the scope that does not depart from the gist of the present invention.

For example, in the above-mentioned embodiment, the present invention is applied to the color image forming apparatus, but can equally be applied to a monochrome image forming apparatus.

Further, in the above-mentioned embodiment, the two pixel attributes, i.e., the character attribute and the gradation attribute, are used, but three pixel attributes, i.e., the character attribute, a vector graphics attribute, and the gradation attribute, may be used. In that case, the number of parameters is three, and the toner consumption is calculated by a linear combination of the printing ratios regarding the character attribute, the vector graphics attribute, and the gradation attribute. Because the number of parameters is three, three or more periods are set as the above-mentioned plurality of periods.

Further, in the above-mentioned embodiment, the value of the parameter ("b" described above) for the gradation attribute among the plurality of pixel attributes may be fixed. In that case, the second calculation portion 42 calculates the toner consumption based on the data values regarding at least one remaining pixel attribute (for example, character attribute) and the parameter for the at least one remaining pixel attribute, and the coefficient calculation portion 43 calculates the value of the parameter for the at least one remaining pixel attribute from the data value regarding the at least one remaining pixel attribute calculated within each of at least one period and the toner consumption calculated by the first calculation method within each of the at least one period. Accordingly, on the image forming apparatus that performs density correction by optically reading a patch pattern regarding the gradation attribute of a toner density, with regard to pixels having the gradation attribute, it is possible to calculate the toner consumption with more accuracy by using the parameter values based on results of the density correction.

The invention is claimed as follows:

1. An image forming apparatus that consumes toner to form an image, the apparatus comprising:

a first calculation portion that calculates a toner consumption by a first calculation method;

a second calculation portion that calculates the toner consumption by a second calculation method according to a predetermined calculation formula after a predetermined switching criterion is satisfied; and a third calculation portion that calculates a value of a parameter in the predetermined calculation formula of the second calculation method based on the toner consumption calculated by the first calculation method, wherein:

the second calculation portion calculates the toner consumption based on data values regarding a plurality of pixel attributes in image data and respective parameters for the plurality of pixel attributes;

the third calculation portion calculates the values of the respective parameters for the plurality of pixel attributes from the data values regarding the plurality of pixel attributes calculated within each of a plurality of periods and the toner consumption calculated by the first calculation method within each of the plurality of periods;

the plurality of pixel attributes comprises a gradation attribute;

the value of the parameter for the gradation attribute is fixed;

the second calculation portion calculates the toner consumption based on the data value regarding at least one remaining pixel attribute and the parameter for the at least one remaining pixel attribute; and the third calculation portion calculates the value of the respective parameter for the at least one remaining pixel attribute from the data value regarding the at least one remaining pixel attribute calculated within each of at least one period and the toner consumption calculated by the first calculation method within each of the at least one period.

2. The image forming apparatus according to claim 1, wherein:

the second calculation portion calculates the toner consumption based on a sum of products of printing ratios regarding the plurality of pixel attributes in the image data and the respective parameters for the plurality of pixel attributes; and the third calculation portion calculates the values of the respective parameters for the plurality of pixel attributes from the printing ratios regarding the plurality of pixel attributes calculated within each of a plurality of periods and the toner consumption calculated by the first calculation method within each of the plurality of periods.

3. The image forming apparatus according to claim 1, wherein:

the plurality of pixel attributes comprise a character attribute and a gradation attribute.

4. The image forming apparatus according to claim 1, wherein the number of the plurality of periods is equal to or larger than the number of the plurality of pixel attributes.

5. The image forming apparatus according to claim 1, wherein the plurality of periods each have a duration longer than a fluctuation cycle of the toner consumption calculated by the first calculation method.

6. The image forming apparatus according to claim 1, wherein:

the predetermined switching criterion comprises whether or not an integrated value of the toner consumption calculated by the first calculation method has reached a predetermined threshold value; and the predetermined threshold value comprises a value within a range in which a toner supplying time and the integrated value of the toner consumption are substantially proportional to each other.

7. The image forming apparatus according to claim 1, wherein the first calculation portion calculates the toner consumption based on one of an operation count and an operating time of a toner carrying portion that carries the toner from a toner cartridge.

8. A toner consumption calculation method of calculating a toner consumption that is an amount of toner consumed in image formation, comprising:

a first toner calculating comprising calculating the toner consumption by a first calculation method;

a second toner calculating comprising calculating the toner consumption by a second calculation method according to a predetermined calculation formula after a predetermined switching criterion is satisfied; and a parameter calculating comprising calculating a value of a parameter in the predetermined calculation formula of the second calculation method based on the toner consumption calculated by the first calculation method, wherein:

the second toner calculating comprises calculating the toner consumption based on data value regarding a plurality of pixel attributes in image data and respective parameters for the plurality of pixel attributes;

the parameters calculating comprises calculating the values of the respective parameters for the plurality of pixel attributes from the data values regarding the plurality of pixel attributes calculated within each of the plurality of periods and the toner consumption calculated by the first calculation method within each of the plurality of periods;

the plurality of pixel attributes comprise a gradation attribute;

the value of the parameter for the gradation attribute is fixed;

the second toner calculating comprises calculating the toner consumption based on the data value regarding at least one remaining pixel attribute and the parameter for the at least one remaining pixel attribute; and the parameter calculating comprises calculating the value of the respective parameter for the at least one remaining pixel attribute from the data value regarding the at least one remaining pixel attribute calculated within each of the at least one period and the toner consumption calculated by the first calculation method within each of the at least one period.

9. The toner consumption calculation method according to claim 8, wherein:

the second toner calculating comprises calculating the toner consumption based on a sum of products of printing ratios regarding the plurality of pixel attributes in the image data and the respective parameters for the plurality of pixel attributes; and the parameter calculating comprises calculating the values of the respective parameters for the plurality of pixel attributes from the printing ratios regarding the plurality of pixel attributes calculated within each of the plurality of periods and the toner consumption calculated by the first calculation method within each of the plurality of periods.

10. The toner consumption calculation method according to claim 8, wherein: the plurality of pixel attributes comprise a character attribute and a gradation attribute.

11. The toner consumption calculation method according to claim 8, wherein the number of the plurality of periods is equal to or larger than the number of the plurality of pixel attributes.

12. The toner consumption calculation method according to claim 8, wherein the plurality of periods each have a duration longer than a fluctuation cycle of the toner consumption calculated by the first calculation method.

13. The toner consumption calculation method according to claim 8, wherein:

the predetermined switching criterion comprises whether or not an integrated value of the toner consumption calculated by the first calculation method has reached a predetermined threshold value; and the predetermined threshold value comprises a value within a range in which a toner supplying time and the integrated value of the toner consumption are substantially proportional to each other.

14. The toner consumption calculation method according to claim 8, wherein the first toner calculating comprises calculating the toner consumption based on one of an operation count and an operating time of a toner carrying portion that carries the toner from a toner cartridge.

15. The toner consumption calculation method according to claim 8, wherein:

the plurality of pixel attributes comprise a character attribute, a gradation attribute, and a vector graphics attribute.

* * * * *